US008713870B1

(12) United States Patent
Poulsen

(10) Patent No.: US 8,713,870 B1
(45) Date of Patent: May 6, 2014

(54) THERMAL MANAGEMENT FOR A FLIGHT DECK OR OTHER AVIATION SURFACE

(71) Applicant: Peter D. Poulsen, Grant Pass, OR (US)

(72) Inventor: Peter D. Poulsen, Grant Pass, OR (US)

( * ) Notice: Subject to any disclaimer, the term of this patent is extended or adjusted under 35 U.S.C. 154(b) by 0 days.

(21) Appl. No.: 13/653,532

(22) Filed: Oct. 17, 2012

Related U.S. Application Data

(60) Provisional application No. 61/548,149, filed on Oct. 17, 2011.

(51) Int. Cl.
*E04B 7/00* (2006.01)

(52) U.S. Cl.
USPC ..... 52/263; 52/508; 52/169.5

(58) Field of Classification Search
USPC ..... 52/169.5, 169.14, 302.3, 61, 232, 52/789.1, 508, 263; 405/38, 49; 428/178
See application file for complete search history.

(56) References Cited

U.S. PATENT DOCUMENTS

| | | | | |
|---|---|---|---|---|
| 2,280,631 | A * | 4/1942 | Coffey | 181/293 |
| 3,182,727 | A | 5/1965 | Minton | |
| 3,380,206 | A | 4/1968 | Barnett | |
| 4,251,579 | A | 2/1981 | Lee et al. | |
| 5,044,821 | A | 9/1991 | Johnsen | |
| 5,585,047 | A | 12/1996 | Mortensen et al. | |
| 5,820,296 | A | 10/1998 | Goughnour | |
| 5,894,045 | A | 4/1999 | Desrondiers | |
| 6,004,652 | A * | 12/1999 | Clark | 428/133 |
| 8,122,656 | B1 | 2/2012 | Poulsen | |
| 2002/0139068 | A1 | 10/2002 | Janesky | |
| 2004/0050723 | A1 | 3/2004 | Wilke et al. | |

OTHER PUBLICATIONS

Office Action dated Apr. 14, 2010 in co-owned U.S. Appl. No. 10/944,620 (now Pat. No. 8,122,656).
Office Action dated Oct. 29, 2010 in co-owned U.S. Appl. No. 10/944,620 (now Pat. No. 8,122,656).
Allowance dated Nov. 1, 2011 in co-owned U.S. Appl. No. 10/944,620 (now Pat. No. 8,122,656).

* cited by examiner

*Primary Examiner* — Jeanette E Chapman
*Assistant Examiner* — Daniel Kenny
(74) *Attorney, Agent, or Firm* — David S. Alavi

(57) ABSTRACT

A thermal management surface system comprises a substantially flat sheet and a plurality of support members. The sheet has a plurality of open funnel-like channels therethrough with a larger upper opening and a smaller, spout-like lower opening. The support members lie on a support surface in a spaced-apart arrangement with the sheet resting on the support members substantially parallel to and offset vertically above the support surface; the support surface and the sheet thereby define a containment space. Each of the spout-like lower openings is canted to impart lateral momentum on gas flowing into the upper opening and out of the lower opening. Groups of multiple contiguous channels can have spout-like lower openings canted substantially along a common direction, so that gas flowing out of those lower openings flows along the common direction through the containment space.

43 Claims, 2 Drawing Sheets

THERMAL MANAGEMENT FOR A FLIGHT DECK OR OTHER AVIATION SURFACE

BENEFIT CLAIMS TO RELATED APPLICATIONS

This application claims benefit of co-pending U.S. provisional App. No. 61/548,149 entitled "Thermal management and fire suppression for a flight deck or other aviation surface" filed Oct. 17, 2011 in the name of Peter D. Poulsen, said provisional application being hereby incorporated by reference as if fully set forth herein.

BACKGROUND

The field of the present invention relates to thermal management and fire suppression on a flight deck or other aviation surface. In particular, a surface structure is disclosed that directs and dissipates heat deposited on the surface by flow of hot exhaust gasses.

This application is related to subject matter disclosed in U.S. provisional App. No. 60/504,350 filed Sep. 18, 2003 and U.S. non-provisional application Ser. No. 10/944,620 filed Sep. 17, 2004 (now U.S. Pat. No. 8,122,656), both of said applications being incorporated by reference as if fully set forth herein.

SUMMARY

A thermal management surface system comprises a substantially flat sheet and a plurality of support members. The substantially flat sheet has a plurality of open funnel-like channels therethrough; each fluid channel has an upper opening at an upper surface of the sheet and a corresponding spout-like lower opening at a lower surface of the sheet. The support members are arranged to lie on a support surface in a spaced-apart arrangement with the sheet resting on the support members. The sheet is thereby positioned substantially parallel to and offset vertically above the support surface; the support surface and the sheet thereby define a containment space. The area of each upper opening is larger than the area of each corresponding lower opening. Each of the spout-like lower openings is canted so as to impart lateral momentum on gas flowing into the upper opening and out of the lower opening into the containment space.

The plurality of channels can be arranged so that groups of multiple contiguous channels that have corresponding spout-like lower openings canted substantially along a common corresponding direction, so that gas flowing out of those lower openings flows substantially along the corresponding common direction through the containment space. The channels can be arranged so that gas flowing through the containment space draws ambient air through the channels into the containment space. Each of the groups of contiguous channels can extend substantially along the corresponding common direction substantially from edge to edge across the sheet. Each of the groups of contiguous channels can be arranged so that the corresponding spout-like lower openings are separated from the spout-like lower openings of an adjacent one of the groups by one or more of the support members. The plurality of support members can comprise a set of elongated, substantially parallel support members extending substantially from edge to edge across the sheet, so that each one of the groups of contiguous channels occupies an area between adjacent pairs of support members and the corresponding common direction of a first subset of the groups is opposite the corresponding common direction of a second subset of the groups. The support members or the lower surface of the sheet can be arranged so that gas flow along the common direction within the containment space causes liquid coolant in the containment space to flow in the common direction.

The channels can be arranged to enable fluid spilled on the upper surface of the sheet to flow therethrough by flowing through at least one of channels, the containment space can be arranged to receive fluid spilled on the upper surface of the sheet that flows through the channels, and the area of each upper opening can be larger than about twice the area of each corresponding lower opening so as to restrict flow of air into the containment space or restrict escape of combustion products from the containment space, thereby suppressing combustion of a flammable fluid spilled on the upper surface of the sheet.

Objects and advantages pertaining to thermal management for an aviation surface may become apparent upon referring to the exemplary embodiments illustrated in the drawings and disclosed in the following written description or appended claims.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

It should be noted that the embodiments depicted in this disclosure are shown only schematically, and that not all features may be shown in full detail or in proper proportion. Certain features or structures may be exaggerated relative to others for clarity. It should be noted further that the embodiments shown are exemplary only, and should not be construed as limiting the scope of the disclosure.

DETAILED DESCRIPTION OF EMBODIMENTS

The disclosed embodiments address the problem of thermal management on a ship's flight deck or other aviation surface. The disclosed surface material also can provide an exceptional non-skid surface, can serve as a fire suppressant for large quantities of flaming aviation fuel resulting from spills or crashes, can service well against harsh environments, and can have a long service life. Its panels can be readily installed, lifted, or cleaned. It can be robust against foreign object damage. It can be integrated with fire nozzles or other conventional firefighting gear or systems without diminishing existing firefighting capability, and can enhance firefighting effectiveness.

Two modes of use are disclosed herein for providing a solution to the problem of thermal management on a flight deck. One mode is passive; the second adds a liquid coolant to the system using, for example, a dedicated water source or already existing fire suppression nozzles. In the subsequent description, "deck" or "flight deck" shall be understood to encompass any aviation surface wherein use of the disclosed surface material would be suitable or desirable within the given context.

Figure 1:
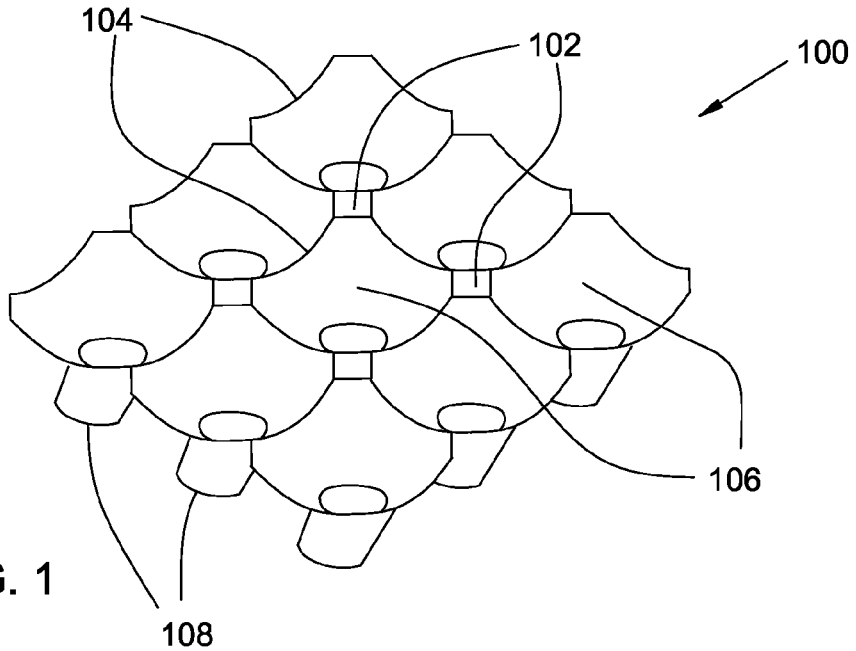
FIG. 1 is a perspective view of an upper surface of an example of the disclosed surface material.
Figure 2:
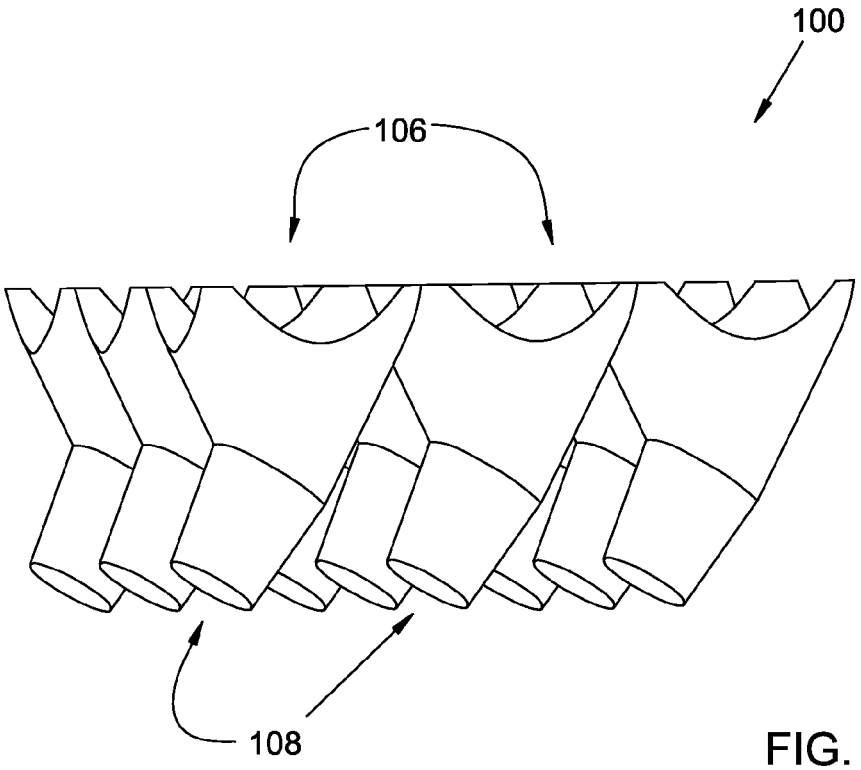
FIG. 2 is a side view of the example of FIG. 1.
Figure 3:
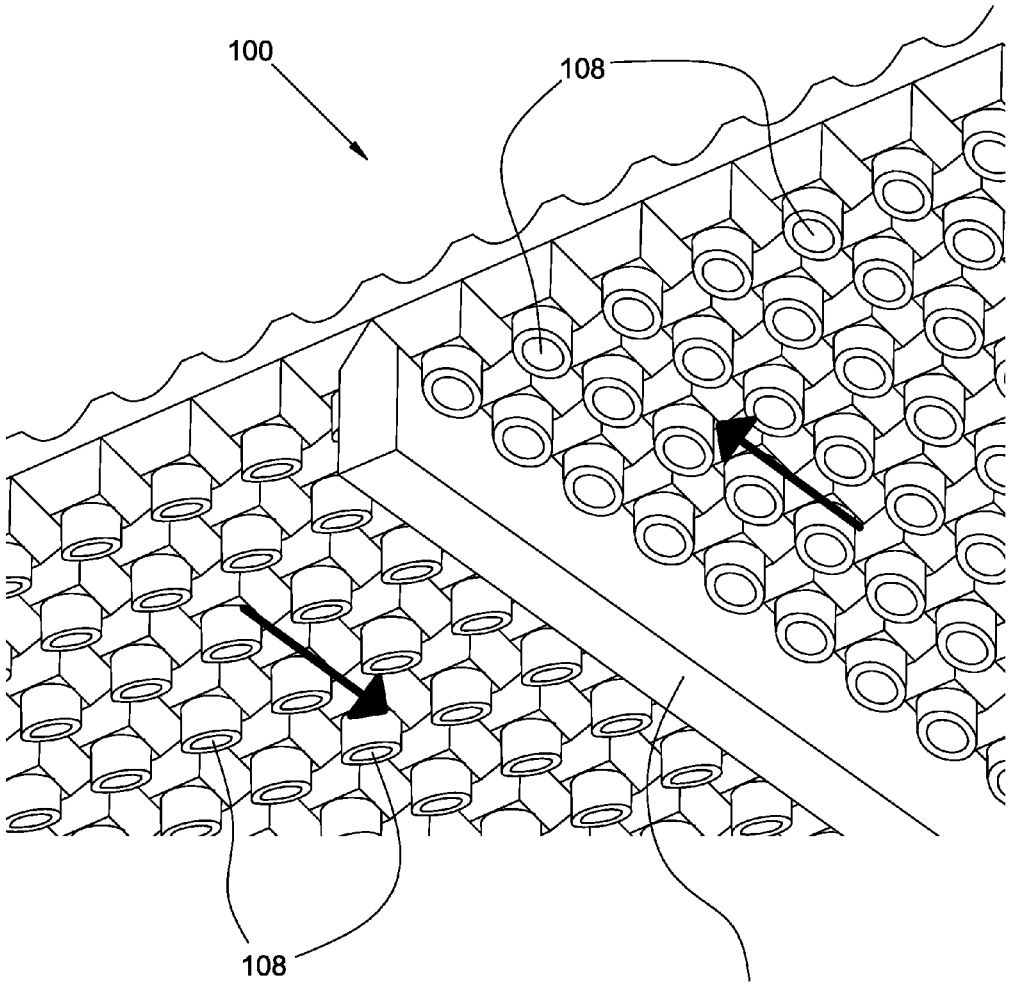
FIG. 3 is a perspective view of a lower surface of another example of the disclosed surface material.

FIGS. 1-3 illustrate schematically exemplary structures of the surface material 100, which can be fabricated using any of the materials or methods disclosed in App. Nos. 60/504,350 and Ser. No. 10/944,620 incorporated above. The upper face of the surface is a grating designed with peaks 102 and ridges 104 sufficiently narrow that fluids cannot easily accumulate on the face. Further, there is relatively little surface area that is normal to the downward flow of exhaust gases, e.g., from a vertical-take-off aircraft. That lack of substantially horizontal surface area also has the advantage of reducing slips and skids. Downwardly directed exhaust is forced through the grating openings and into the grating holes and passes downward through the bottom face of the surface material 100 into a volume below the surface, all driven by the force of the exhaust flow. The surface material 100 typically is supported on and vertically offset from an underlying flight deck surface by support members or stand-offs 110, thereby forming the underlying volume between the deck and the surface material. The walls of the grating holes can be appropriately smoothed to facilitate passage of the exhaust gases, and have top openings 106 that are considerably larger than the bottom openings 108. This forms a funnel-like structure for each of the grating elements, as disclosed in App. Nos. 60/504,350 and Ser. No. 10/944,620 incorporated above. By making the walls of the tapered holes appropriately slanted and surface-finished, reflections of radiant energy can be diverted upward away from nearby personnel and apparatus, and gas flow friction can be reduced.

FIGS. 1 and 2 show an area three cells by three cells of the disclosed surface material 100. A single module or panel of the surface material 100 typically has numerous contiguous cells, as shown in FIG. 3. Panels of the surface material can be made in any desired size or shape with any suitable or desired number of cells, and multiple panels can be assembled to cover an area of any suitable or desired size or shape. The cells in one example are spaced in a square array approximately 0.3 inches on center, which can be advantageously employed in some installations of the surface material. That spacing and arrangement, however, can be readily changed as appropriate to specific applications. Each "cell" acts as a small funnel having top edges truncated to enable the funnels to be closely packed in the chosen array geometry. This typically results in a narrow ridge 104 that recesses below the level of the corners 102 where the funnels meet. The size of the corners 102 where the cells meet can be varied as desired by altering the thickness of the surface material relative to the spacing and cone angle of the funnels. These corner squares 102 are the surface on which a person walks or an object rests, and provide a strong anti-slip surface, even in the presence of, e.g., firefighting foam or other slippery materials. They can be shaped to have rounded surfaces if desired. In some instances such rounded surfaces are desirable, so as to eliminate sharp edges on which personnel can be injured or objects damaged. Fire suppression/prevention and non-slip characteristics of the surface material are disclosed in App. No. 60/504,350 and Ser. No. 10/944,620 incorporated above.

Each funnel has its spout (i.e., lower end 108) canted relative to the surface normal direction so that fluid (a gas or a liquid) passing into it is given lateral momentum as it flows through the surface material 100 and into a volume beneath it. In the example of FIGS. 1 and 2, each funnel has a lower, spout-like portion that is tilted with respect to the direction normal to the surface material 100 (i.e., that is non-vertical); in the example of FIG. 3, each funnel has a lower, spout-like portion that is substantially vertical but has a slanted lower edge around the lower opening; these and other arrangements, or combinations thereof, for canting the spout-like lower openings of the funnel-like channels to impart lateral momentum on gas flowing through them can be employed within the scope of the present disclosure or appended claims. The surface shape where gases or liquids flow into a cell can be adjusted to suit aerodynamic and/or hydrodynamic needs or desires. For example, it may be desired that the exhaust flowing into the volume below the surface material not be turbulent; in that case, the input shape of each funnel would be designed to encourage transfer of the exhaust from the top of the surface material into laminar flow at the output of the canted spouts 108.

Groups of contiguous cells have their spouts canted in the same direction so that, once under the surface material 100, the exhaust gases from each of the group of contiguous cells flows in the same direction below the surface material. That flow pulls atmospheric mixing air through the surface material into the flow below the surface material, thereby cooling the hot gases even as they are being transported away from the center of an engine's downflow, for example. The shapes of the underside elements (e.g., the spouts 108) as presented to the airflow (potentially water flow as well) are typically designed to enhance laminar flow, so as to reduce turbulence and back pressure that would otherwise degrade the ability of the system to transport heat away from the downflow vicinity. In one example suitable for flight deck thermal control purposes, a goal for air/exhaust mixing ratios of at least 3:1 is believed to be sufficient to provide adequate thermal management. If needed or desired, additional routing channels can be incorporated into the surface material for ambient air to be pulled into the flow by a Venturi effect created by the exhaust gas flowing beneath the surface material.

In addition to the passive effects of the surface material described above, the thermal management capacity of the surface material can be augmented by using water or other liquid coolant (water is disclosed as an example in what follows; other suitable liquid coolant can be employed, e.g., seawater or brine, water/glycol mixtures, and so on). In a coolant-augmented approach, water (or other liquid coolant) is pumped into the airflow channels below the surface material behind the gases that enter through the funnels in the surface material itself. Traveling around and below the funnel spouts (which can occupy considerably more exterior volume than their interior volume), the water becomes entrained in the exhaust flow and is carried into the heated regions below the surface material 100, e.g., below aircraft engines. As a result, the exhaust in which the water is entrained, as well as the surface material 100 heated by the exhaust, is cooled. The flow of the exhaust along flow channels below the surface material (e.g., between support members or stand-offs 110 separating the surface material from the underlying deck surface) pulls and propels water that it is introduced into those flow channels at the rear of the flow direction (indicated by the arrows in FIG. 3).

The latent heat of vaporization for water is approximately 2,270 kJ/kg. Accordingly, even if the water were already heated to 99° C., the necessary rate of flow to absorb 16,000 BTU/min of exhaust heat would be about 2 gallons per minute. Three gallons per minute would accommodate 24,000 BTU/min. Assuming an exhaust footprint having a dimension of 40 inches across the water flow, and an average open height of 0.50 inches beneath the surface material (i.e., the height of the containment space between the surface material 100 and the underlying support surface on which rest support members or stand-offs 110), the flow area for the water is on the order of 30 standard garden hoses. Obtaining a flow rate of 3 gallons per minute with 30 hoses, even at low pressure, can be readily achieved. The result of that flow would be a flight deck kept well below 300° F. However, a constant production of steam is not desirable. Accordingly, a flow rate of two or three times the 3 gallons per minute would be desirable, and still readily achievable.

With the mass flow of the downward directed exhaust striking a conventional flat flight deck, getting water into the downward flow to contact the deck and thereby keep it cool is difficult. There is a significant stagnation area as far as getting fluid to flow inward against the radially deflecting exhaust mass of several pounds per second. Those who are familiar with this phenomenon might be hesitant to expect that water can be introduced at all, let alone achieve a uniform distribution and a sufficient flow rate. Using the disclosed surface material, however, the problem of insurmountable stagnation is substantially eliminated by the aforementioned canting of each cell's exit spout.

Alternate fluid flow channels beneath the surface material can have flow cell outflow angles canted in opposite directions, as shown in FIG. 3. This alternation provides propulsive balancing and accommodates the alternate tilt directions arising from ship roll. The alternately opposing flow design can be incorporated into surface material even if not used with water flowing beneath it. Propulsive balancing refers to reduction or elimination of net lateral thrust on the surface material due to sideways jet thrusting produced by the horizontally diverted exhaust (and entrained water if present). The fluid flow channels that are created by the parallel aligned standoffs 110 that hold the surface material 100 at a specified height above the deck, e.g., about a quarter to a half of an inch, are typically spaced, e.g., a few inches apart (desirable height and spacing in some instances; any suitable or desirable height and spacing can be employed). The sideways thrust along one channel is at least partly counteracted by one or more adjacent channels, which have their exhaust and water flowing in the opposite direction.

The water channels can be aligned with the roll of the ship, so that as the ship rolls the water may be contained more readily within one set of channels than the other (e.g., a channel with its funnels canted in the same direction as the ship's roll being less likely to allow water flow upward through the surface material in the regions outside of the impact of exhaust flow).

In addition to the preceding, the following examples fall within the scope of the present disclosure or appended claims:

Example 1

A thermal management surface system comprising: a substantially flat sheet having a plurality of open funnel-like channels therethrough, each fluid channel having an upper opening at an upper surface of the sheet and a corresponding spout-like lower opening at a lower surface of the sheet; and a plurality of support members, wherein: the support members are arranged to lie on a support surface in a spaced-apart arrangement with the sheet resting on the support members so that the sheet is thereby positioned substantially parallel to and offset vertically above the support surface, the support surface and the sheet thereby defining a containment space; the area of each upper opening is larger than the area of each corresponding lower opening; and each of the spout-like lower openings is canted so as to impart lateral momentum on gas flowing into the upper opening and out of the lower opening into the containment space.

Example 2

A method for managing a thermal load of gas downwardly directed onto a support surface, the method comprising covering at least a portion of the support surface with a substantially flat sheet supported by a plurality of support members, wherein: the substantially flat sheet has a plurality of open funnel-like channels therethrough, each fluid channel having an upper opening at an upper surface of the sheet and a corresponding spout-like lower opening at a lower surface of the sheet; the support members are arranged to lie on a support surface in a spaced-apart arrangement with the sheet resting on the support members so that the sheet is thereby positioned substantially parallel to and offset vertically above the support surface, the support surface and the sheet thereby defining a containment space; the area of each upper opening is larger than the area of each corresponding lower opening; and each of the spout-like lower openings is canted so as to impart lateral momentum on gas flowing into the upper opening and out of the lower opening into the containment space.

Example 3

The method of Example 2 wherein the support surface comprises at least a portion of: a runway, taxiway, apron, or ramp of an aerodrome; a flight deck of an aircraft carrier or other marine vessel; a helipad; or another aviation surface.

Example 4

A method for forming a thermal management surface system, the method comprising: forming a substantially flat sheet having a plurality of open funnel-like channels therethrough, each fluid channel having an upper opening at an upper surface of the sheet and a corresponding spout-like lower opening at a lower surface of the sheet; and forming a plurality of support members, wherein: the support members are arranged to lie on a support surface in a spaced-apart arrangement with the sheet resting on the support members so that the sheet is thereby positioned substantially parallel to and offset vertically above the support surface, the support surface and the sheet thereby defining a containment space; the area of each upper opening is larger than the area of each corresponding lower opening; and each of the spout-like lower openings is canted so as to impart lateral momentum on gas flowing into the upper opening and out of the lower opening into the containment space.

Example 5

The method of Example 4 wherein the sheet is formed by molding, casting, stamping, extrusion, or milling.

Example 6

The system or method of any preceding Example wherein the plurality of channels are arranged so that groups of multiple contiguous channels have corresponding spout-like lower openings canted substantially along a common corresponding direction, so that gas flowing out of those lower openings flows substantially along the corresponding common direction through the containment space.

Example 7

The system or method of Example 6 wherein the channels are arranged so that gas flowing through the containment space draws ambient air through the channels into the containment space.

Example 8

The system or method of any one of Examples 6 or 7 wherein the lower surface of the sheet, including the spout-like lower openings, is arranged to facilitate substantially laminar flow of gas or liquid through the containment space.

Example 9

The system or method of any one of Examples 6-8 wherein each of the groups of contiguous channels extends substantially along the corresponding common direction substantially from edge to edge across the sheet.

Example 10

The system or method of Example 9 wherein each of the groups of contiguous channels is arranged so that the corresponding spout-like lower openings are separated from the spout-like lower openings of an adjacent one of the groups by one or more of the support members.

Example 11

The system or method of Example 10 wherein the plurality of support members comprise a set of elongated, substantially parallel support members extending substantially from edge to edge across the sheet, each one of the groups of contiguous channels occupies an area between adjacent pairs of support members, the corresponding common direction of a first subset of the groups is opposite the corresponding common direction of a second subset of the groups.

Example 12

The system or method of Example 11 wherein the groups of the first subset alternate with the groups of the second subset across the sheet.

Example 13

The system or method of any one of Examples 9-12 wherein the support surface is a flight deck of a marine vessel, and the surface system is arranged so that the common direction is substantially aligned with roll of the vessel.

Example 14

The system or method of any one of Examples 9-12 wherein the support members or the lower surface of the sheet are arranged so that gas flow along the common direction within the containment space causes liquid coolant in the containment space to flow in the common direction.

Example 15

The system or method of any preceding Example wherein each funnel-like channel or corresponding spout-like lower opening is arranged to facilitate substantially laminar flow of gas flowing into the upper opening and out of the lower opening.

Example 16

The system or method of any preceding Example wherein: the plurality of channels is arranged to enable fluid spilled on the upper surface of the sheet to flow therethrough by flowing through at least one of channels; the containment space is arranged to receive fluid spilled on the upper surface of the sheet that flows through the channels; and the area of each upper opening is larger than about twice the area of each corresponding lower opening so as to restrict flow of air into the containment space or restrict escape of combustion products from the containment space, thereby suppressing combustion of a flammable fluid spilled on the upper surface of the sheet.

Example 17

The system or method of any preceding Example wherein the sheet comprises metallic material, ceramic material, or polymer material.

Example 18

The system or method of any preceding Example wherein the sheet comprises metallic material, and the plurality of channels are arranged so that the sheet can serve as an electromagnetic specular ground plane over a desired operating frequency range.

Example 19

The system or method of any preceding Example wherein the area of each channel decreases substantially monotonically from the upper opening to the lower opening.

Example 20

The system or method of any preceding Example wherein an upper portion of each channel is frustoconical in shape.

Example 21

The system or method of any preceding Example wherein the channels are arranged so that heat radiated from below the sheet is preferentially redirected by the sheet in a direction substantially perpendicular to the sheet.

Example 22

The system or method of any preceding Example wherein the area of each lower opening is less than about 10 $mm^2$, the sheet is between about 3 mm thick and about 10 mm thick, and the channels are arranged in a two-dimensional lattice pattern with a spacing between about 3 mm and about 10 mm.

Example 23

The system or method of any preceding Example wherein the spacing of the channels and the area of the upper openings thereof result in an upper sheet surface comprising a plurality of ridges extending along the sheet in at least two directions thereby forming a grid.

Example 24

The system or method of Example 23 wherein the upper area of the plurality of ridges is sufficiently small so as to substantially eliminate fluid accumulation on the upper surface of the sheet.

Example 25

The system or method of any one of Examples 23 or 24 wherein the plurality of ridges comprising the upper sheet surface provide a non-slip or non-skid surface.

Example 26

The system or method of any preceding Example wherein the support members comprise a plurality of elongated support members lying on the support surface in a spaced-apart, side-by-side arrangement.

Example 27

The system or method of Example 26 wherein the support members are secured to or formed on the lower surface of the sheet.

Example 28

The system or method of any one of Examples 26 wherein the support members and the sheet comprise mechanically discrete components.

Example 29

The system or method of Example 28 the support members are secured to or formed on the support surface.

Example 30

The system or method of any preceding Example wherein the support members support the sheet at a height above the support surface between about 3 mm and about 10 mm.

Example 31

The system or method of any preceding Example wherein fire retardant material is applied to the lower surface of the sheet.

Example 32

The system or method of Example 31 wherein the lower surface of the sheet includes recessed regions between the spout-like lower openings, and the recessed regions contain the fire retardant material.

Example 33

The system or method of any one of Examples 31 or 32 wherein the fire retardant material comprises a binary agent, a decomposing agent, or a de-volatilizing agent.

Example 34

The system or method of any preceding Example wherein the lower surface of the sheet includes recessed regions between the spout-like lower openings, thereby enhancing convective cooling of the sheet.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

In the foregoing Detailed Description and in incorporated App. No. 60/504,350 and Ser. No. 10/944,620, various features are disclosed and may be grouped together in several exemplary embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed exemplary embodiment. Thus, the appended claims are hereby incorporated into the Detailed Description, with each claim standing on its own as a separate disclosed embodiment. However, the present disclosure, including incorporated App. No. 60/504,350 and Ser. No. 10/944,620, shall also be construed as implicitly disclosing any embodiment having any suitable set of one or more disclosed or claimed features (i.e., sets of features that are not incompatible or mutually exclusive) that appear in the present disclosure, incorporated App. No. 60/504,350 and Ser. No. 10/944,620, or the appended claims, including those sets that may not be explicitly disclosed herein. It should be further noted that the scope of the appended claims do not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising," "including," "having," and variants thereof, wherever they appear, shall be construed as open ended terminology, with the same meaning as if the phrase "at least" were appended after each instance thereof.

In the appended claims, if the provisions of 35 USC §112 ¶ 6 are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112 ¶ 6 are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A thermal management surface system comprising:

a substantially flat sheet having a plurality of open funnel-like channels therethrough, each fluid channel having an upper opening at an upper surface of the sheet and a corresponding spout-like lower opening at a lower surface of the sheet; and a plurality of support members, wherein:

the support members are arranged to lie on a support surface in a spaced-apart arrangement with the sheet resting on the support members so that the sheet is thereby positioned substantially parallel to and offset vertically above the support surface, the support surface and the sheet thereby defining a containment space;

the area of each upper opening is larger than the area of each corresponding lower opening; and each of the spout-like lower openings is canted so as to impart lateral momentum on gas flowing into the upper opening and out of the lower opening into the containment space.

2. The surface system of claim 1 wherein the plurality of channels are arranged so that groups of multiple contiguous channels have corresponding spout-like lower openings canted substantially along a common corresponding direction, so that gas flowing out of those lower openings flows substantially along the corresponding common direction through the containment space.

3. The surface system of claim 2 wherein the channels are arranged so that gas flowing through the containment space draws ambient air through the channels into the containment space.

4. The surface system of claim 2 wherein the lower surface of the sheet, including the spout-like lower openings, is arranged to facilitate substantially laminar flow of gas or liquid through the containment space.

5. The surface system of claim 2 wherein each of the groups of contiguous channels extends substantially along the corresponding common direction substantially from edge to edge across the sheet.

6. The surface system of claim 5 wherein each of the groups of contiguous channels is arranged so that the corresponding spout-like lower openings are separated from the spout-like lower openings of an adjacent one of the groups by one or more of the support members.

7. The surface system of claim 6 wherein the plurality of support members comprise a set of elongated, substantially parallel support members extending substantially from edge to edge across the sheet, each one of the groups of contiguous channels occupies an area between adjacent pairs of support members, the corresponding common direction of a first subset of the groups is opposite the corresponding common direction of a second subset of the groups.

8. The surface system of claim 7 wherein the groups of the first subset alternate with the groups of the second subset across the sheet.

9. The surface system of claim 5 wherein the support surface is a flight deck of a marine vessel, and the surface system is arranged so that the common direction is substantially aligned with roll of the vessel.

10. The surface system of claim 5 wherein the support members or the lower surface of the sheet are arranged so that gas flow along the common direction within the containment space causes liquid coolant in the containment space to flow in the common direction.

11. The surface system of claim 1 wherein each funnel-like channel or corresponding spout-like lower opening is arranged to facilitate substantially laminar flow of gas flowing into the upper opening and out of the lower opening.

12. The surface system of claim 1 wherein:

the plurality of fluid channels is arranged to enabling fluid spilled on the upper surface of the sheet to flow therethrough by flowing through at least one of the channels;

the containment space is arranged to receive fluid spilled on the upper surface of the sheet that flows through the channels; and the area of each upper opening is larger than about twice the area of each corresponding lower opening so as to restrict flow of air into the containment space or restrict escape of combustion products from the containment space, thereby suppressing combustion of a flammable fluid spilled on the upper surface of the sheet.

13. The surface system of claim 1 wherein the sheet comprises metallic material, ceramic material, or polymer material.

14. The surface system of claim 1 wherein an upper portion of each channel is frustoconical in shape.

15. The surface system of claim 1 wherein the area of each lower opening is less than about 10 $mm^2$, the sheet is between about 3 mm thick and about 10 mm thick, and the channels are arranged in a two-dimensional lattice pattern with a spacing between about 3 mm and about 10 mm.

16. The surface system of claim 1 wherein the support members are secured to or formed on the lower surface of the sheet.

17. The surface system of claim 1 wherein the support members support the sheet at a height above the support surface between about 3 mm and about 10 mm.

18. The surface system of claim 1 wherein the lower surface of the sheet includes recessed regions between the spout-like lower openings, thereby enhancing convective cooling of the sheet.

19. A method for managing a thermal load of gas downwardly directed onto a support surface, the method comprising covering at least a portion of the support surface with a substantially flat sheet supported by a plurality of support members, wherein:

the substantially flat sheet has a plurality of open funnel-like channels therethrough, each fluid channel having an upper opening at an upper surface of the sheet and a corresponding spout-like lower opening at a lower surface of the sheet;

the support members are arranged to lie on a support surface in a spaced-apart arrangement with the sheet resting on the support members so that the sheet is thereby positioned substantially parallel to and offset vertically above the support surface, the support surface and the sheet thereby defining a containment space;

the area of each upper opening is larger than the area of each corresponding lower opening; and each of the spout-like lower openings is canted so as to impart lateral momentum on gas flowing into the upper opening and out of the lower opening into the containment space.

20. The method of claim 19 wherein the plurality of channels are arranged so that groups of multiple contiguous channels have corresponding spout-like lower openings canted substantially along a common corresponding direction, so that gas flowing out of those lower openings flows substantially along the corresponding common direction through the containment space.

21. The method of claim 20 wherein the channels are arranged so that gas flowing through the containment space draws ambient air through the channels into the containment space.

22. The method of claim 20 wherein the lower surface of the sheet, including the spout-like lower openings, is arranged to facilitate substantially laminar flow of gas or liquid through the containment space.

23. The method of claim 20 wherein each of the groups of contiguous channels extends substantially along the corresponding common direction substantially from edge to edge across the sheet.

24. The method of claim 23 wherein each of the groups of contiguous channels is arranged so that the corresponding spout-like lower openings are separated from the spout-like lower openings of an adjacent one of the groups by one or more of the support members.

25. The method of claim 24 wherein the plurality of support members comprise a set of elongated, substantially parallel support members extending substantially from edge to edge across the sheet, each one of the groups of contiguous channels occupies an area between adjacent pairs of support members, the corresponding common direction of a first subset of the groups is opposite the corresponding common direction of a second subset of the groups.

26. The method of claim 25 wherein the groups of the first subset alternate with the groups of the second subset across the sheet.

27. The method of claim 23 wherein the support surface is a flight deck of a marine vessel, and the surface system is arranged so that the common direction is substantially aligned with roll of the vessel.

28. The method of claim 23 wherein the support members or the lower surface of the sheet are arranged so that gas flow along the common direction within the containment space causes liquid coolant in the containment space to flow in the common direction.

29. The method of claim 19 wherein each funnel-like channel or corresponding spout-like lower opening is arranged to facilitate substantially laminar flow of gas flowing into the upper opening and out of the lower opening.

30. The method of claim 19 wherein:

the plurality of fluid channels is arranged to enabling fluid spilled on the upper surface of the sheet to flow therethrough by flowing through at least one of the channels;

the containment space is arranged to receive fluid spilled on the upper surface of the sheet that flows through the channels; and the area of each upper opening is larger than about twice the area of each corresponding lower opening so as to restrict flow of air into the containment space or restrict escape of combustion products from the containment space, thereby suppressing combustion of a flammable fluid spilled on the upper surface of the sheet.

31. The method of claim 19 wherein the support surface comprises at least a portion of: a runway, taxiway, apron, or ramp of an aerodrome; a flight deck of an aircraft carrier or other marine vessel; a helipad; or another aviation surface.

32. The method of claim 19 wherein the lower surface of the sheet includes recessed regions between the fluid channels, thereby enhancing convective cooling of the sheet.

33. A method for forming a thermal management surface system, the method comprising:

forming a substantially flat sheet having a plurality of open funnel-like channels therethrough, each fluid channel having an upper opening at an upper surface of the sheet and a corresponding spout-like lower opening at a lower surface of the sheet; and forming a plurality of support members, wherein:

the support members are arranged to lie on a support surface in a spaced-apart arrangement with the sheet resting on the support members so that the sheet is thereby positioned substantially parallel to and offset vertically above the support surface, the support surface and the sheet thereby defining a containment space;

the area of each upper opening is larger than the area of each corresponding lower opening; and each of the spout-like lower openings is canted so as to impart lateral momentum on gas flowing into the upper opening and out of the lower opening into the containment space.

34. The method of claim 33 wherein the plurality of channels are arranged so that groups of multiple contiguous channels have corresponding spout-like lower openings canted substantially along a common corresponding direction, so that gas flowing out of those lower openings flows substantially along the corresponding common direction through the containment space.

35. The method of claim 34 wherein the channels are arranged so that gas flowing through the containment space draws ambient air through the channels into the containment space.

36. The method of claim 34 wherein the lower surface of the sheet, including the spout-like lower openings, is arranged to facilitate substantially laminar flow of gas or liquid through the containment space.

37. The method of claim 34 wherein each of the groups of contiguous channels extends substantially along the corresponding common direction substantially from edge to edge across the sheet.

38. The method of claim 37 wherein each of the groups of contiguous channels is arranged so that the corresponding spout-like lower openings are separated from the spout-like lower openings of an adjacent one of the groups by one or more of the support members.

39. The method of claim 38 wherein the plurality of support members comprise a set of elongated, substantially parallel support members extending substantially from edge to edge across the sheet, each one of the groups of contiguous channels occupies an area between adjacent pairs of support members, the corresponding common direction of a first subset of the groups is opposite the corresponding common direction of a second subset of the groups.

40. The method of claim 37 wherein the support members or the lower surface of the sheet are arranged so that gas flow along the common direction within the containment space causes liquid coolant in the containment space to flow in the common direction.

41. The method of claim 33 wherein each funnel-like channel or corresponding spout-like lower opening is arranged to facilitate substantially laminar flow of gas flowing into the upper opening and out of the lower opening.

42. The method of claim 33 wherein:

the plurality of fluid channels is arranged to enabling fluid spilled on the upper surface of the sheet to flow therethrough by flowing through at least one of the channels;

the containment space is arranged to receive fluid spilled on the upper surface of the sheet that flows through the channels; and the area of each upper opening is larger than about twice the area of each corresponding lower opening so as to restrict flow of air into the containment space or restrict escape of combustion products from the containment space, thereby suppressing combustion of a flammable fluid spilled on the upper surface of the sheet.

43. The method of claim 33 further comprising forming recessed regions on the lower surface of the sheet, thereby enhancing convective cooling of the sheet.

* * * * *